US009117379B2

(12) United States Patent
Seo et al.

(10) Patent No.: US 9,117,379 B2
(45) Date of Patent: Aug. 25, 2015

(54) BACKLIGHT UNIT, DISPLAY USING THE SAME AND LIGHTING SYSTEM INCLUDING THE SAME

(75) Inventors: Jung In Seo, Seoul (KR); Young Bae Jang, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 632 days.

(21) Appl. No.: 13/365,486

(22) Filed: Feb. 3, 2012

(65) Prior Publication Data

US 2012/0134136 A1 May 31, 2012

(30) Foreign Application Priority Data

Nov. 16, 2011 (KR) ..... 10-2011-0119303

(51) Int. Cl.
*G09F 13/14* (2006.01)
*G09F 13/04* (2006.01)

(52) U.S. Cl.
CPC ..... *G09F 13/0413* (2013.01)

(58) Field of Classification Search
CPC .. G02B 6/0011; G02B 6/0013; G02B 6/0015; G02B 6/0018; G02B 6/0033; G02B 6/0035; G02B 6/0096; G09F 13/0413
USPC ..... 362/606, 607, 609, 610, 612, 613, 615, 362/617–619, 623–625
See application file for complete search history.

(56) References Cited

U.S. PATENT DOCUMENTS 8,596,807 B2 * 12/2013 Jeong et al. ..... 362/97.2
2007/0171676 A1 * 7/2007 Chang ..... 362/613

* cited by examiner

*Primary Examiner* — Thomas M Sember
(74) *Attorney, Agent, or Firm* — KED & Associates LLP

(57) ABSTRACT

Disclosed are a backlight unit, a display using the same and a lighting system including the same. The backlight unit includes a first reflector, a second reflector, at least one light source module disposed between the first reflector and the second reflector, and a bottom cover including a bottom part supporting the second reflector and at least one side wall part inclined and extending from the bottom part.

18 Claims, 8 Drawing Sheets

BACKLIGHT UNIT, DISPLAY USING THE SAME AND LIGHTING SYSTEM INCLUDING THE SAME

CROSS REFERENCE TO RELATED APPLICATION

This application claims priority under 35 U.S.C. §119 to Korean Patent Application No. 10-2011-0119303 filed in Korea on Nov. 16, 2011 which is hereby incorporated in its entirety by reference as if fully set forth herein.

1. TECHNICAL FIELD

Embodiments relate to a display, and more particularly, to a backlight unit, a display using the same and a lighting system including the same.

2. BACKGROUND

In general, as a representative large-scale display, a liquid crystal display (LCD) or a plasma display panel (PDP) is used.

Differently from the PDP of a self-emitting type, the LCD essentially requires a separate backlight unit due to absence of self-emitting light emitting devices.

Backlight units used in LCDs are classified into an edge type backlight unit and a direct type backlight unit according to positions of light sources. In the edge type backlight unit, light sources are disposed on left and right side wall parts and/or upper and lower side wall parts of an LCD panel and a light guide plate is used to uniformly distribute light throughout the overall surface of the LCD panel, and thus uniformity of light is improved and the panel has an ultra-thin thickness.

In the direct type backlight unit which is generally used in displays having a size of 20 inches or more, a plurality of light sources is disposed under a panel. Thus, the direct type backlight unit has excellent optical efficiency, as compared to the edge type backlight unit, thereby being mainly used in large-scale displays requiring high brightness.

As light sources of the conventional edge type or direct type backlight unit, cold cathode fluorescent lamps (CCFLs) are used. However, a backlight unit using CCFLs may consume a considerable amount of power because power is applied to the CCFLs at all times, exhibit a color reproduction rate of about 70% that of a CRT, and cause environmental pollution due to addition of mercury.

In order to solve these problems, research into a backlight unit using light emitting diodes (LEDs) has been conducted now.

If LEDs are used as the backlight unit, an LED array may be partially turned on/off and thus power consumption may be considerably reduced. Particularly, RGB (red, green and blue) LEDs exceed 100% of national television system committee (NTSC) color reproduction range specifications, thus providing a more vivid image to consumers.

Further, LEDs fabricated using a semiconductor process are harmless to the environment.

LCD products employing the LEDs having the above advantages have entered the market recently, but these products have a driving mechanism differing from the conventional CCFL light source and thus a driver and a printed circuit board thereof are expensive. Therefore, the LED backlight unit has been applied only to expensive LCD products.

SUMMARY

Embodiments provide a backlight unit which has low unit costs of reflectors and a bottom cover, a display using the same and a lighting system including the same.

In one embodiment, a backlight unit includes a first reflector, a second reflector, at least one light source module disposed between the first reflector and the second reflector, and a bottom cover including a bottom part supporting the second reflector and at least one side wall part inclined and extending from the bottom part.

The at least one side wall part may be inclined at an angle of 33° to 53° from a surface perpendicular to the bottom part. A horizontal distance from a contact position between the at least one side wall part and the bottom part to the outermost position of the at least one side wall part may be 10 mM to 20 mm.

The at least one side wall part may have a convex or concave surface, as seen from the inside of the bottom cover.

The bottom cover may further comprise at least one edge part extending in a first direction, and the at least one side wall part may extend from the front end of the at least one edge part in a second direction differing from the first direction. The at least one light source module may be disposed in the first direction along the at least one edge part.

A ratio of a horizontal distance from a contact position between the at least one side wall part and the bottom part to the outermost position of the at least one side wall part to a length of the at least one edge part may be 1.85% to 3.85%.

The backlight unit may further include a third reflector supported by the at least one side wall part. The reflectivity of the second reflector and the reflectivity of the third reflector may be different or equal.

The third reflector may be supported by the whole area or a partial area of the at least one side wall part. If the third reflector is supported by a partial area of the at least one side wall part, the third reflector may cover a lower area, an upper area or a central area of the at least one side wall part. The third reflector may contact or be separated from the second reflector.

BRIEF DESCRIPTION OF THE DRAWINGS

Arrangements and embodiments may be described in detail with reference to the following drawings in which like reference numerals refer to like elements and wherein.

DESCRIPTION OF SPECIFIC EMBODIMENTS

Figure 1:
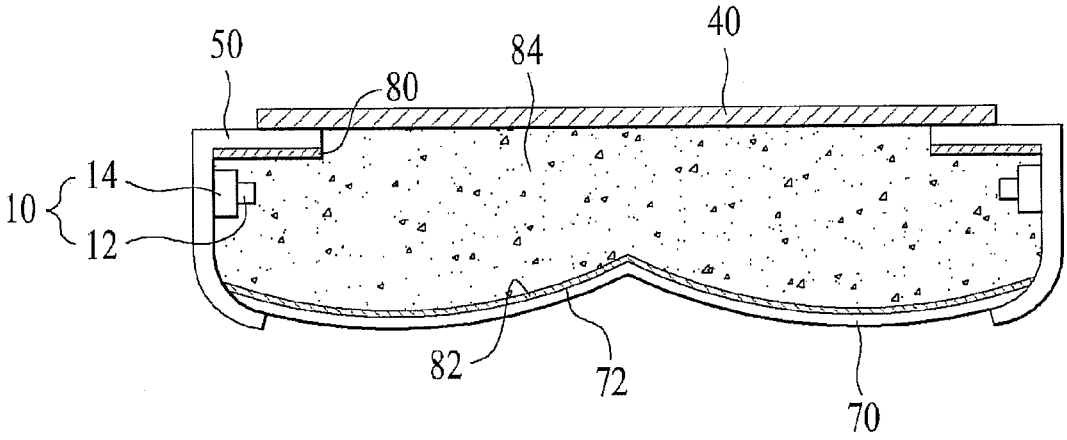
FIG. 1 is a cross-sectional view of a backlight unit in accordance with one embodiment.

Hereinafter, embodiments will be described with reference to the annexed drawings.

It will be understood that when an element is referred to as being "on" or "under" another element, it can be directly on/under the element, and one or more intervening elements may also be present. Further, when an element is referred to as being "on" or "under", "under the element" as well as "on the element" can be included based on the element.

In the drawings, the thicknesses or sizes of respective layers are exaggerated, omitted, or schematically illustrated for convenience and clarity of description. Further, the sizes of the respective elements do not denote the actual sizes thereof.

FIG. 1 is a cross-sectional view of a backlight unit in accordance with one embodiment.

Figure 4A:
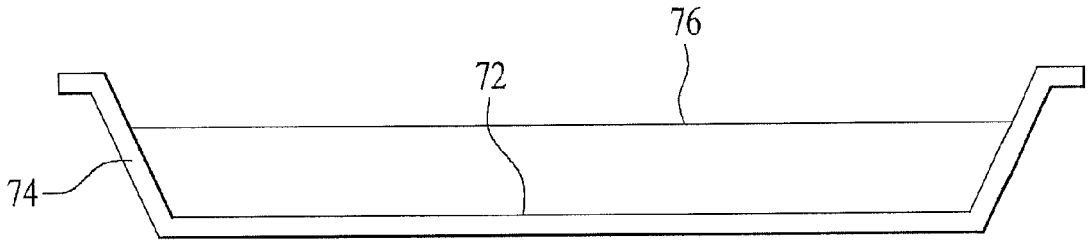
FIGS. 4A to 4G are cross-sectional views taken along the line 3-3' of the bottom cover shown in FIG. 2B, in accordance with an embodiment.
Figure 4B:
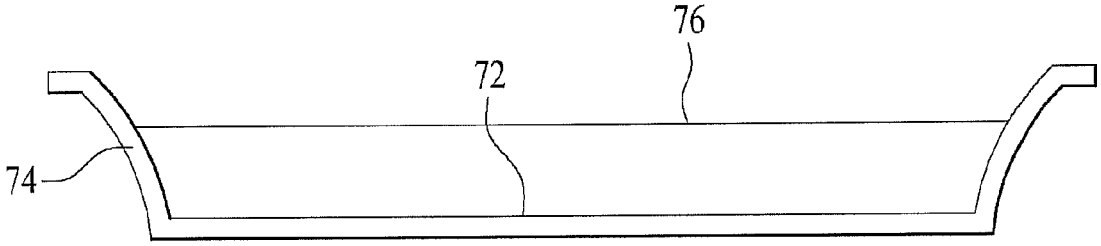
Figure 4C:
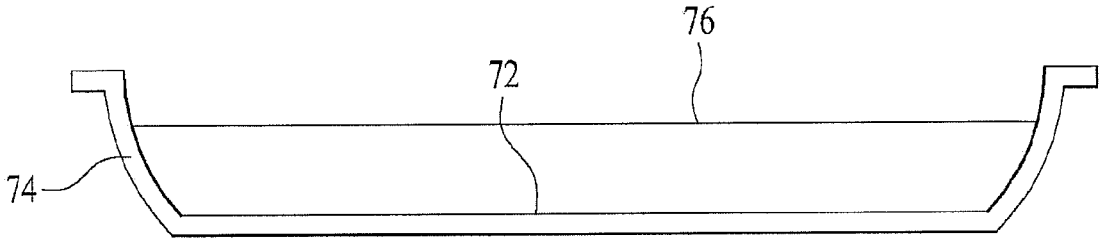
Figure 4D:
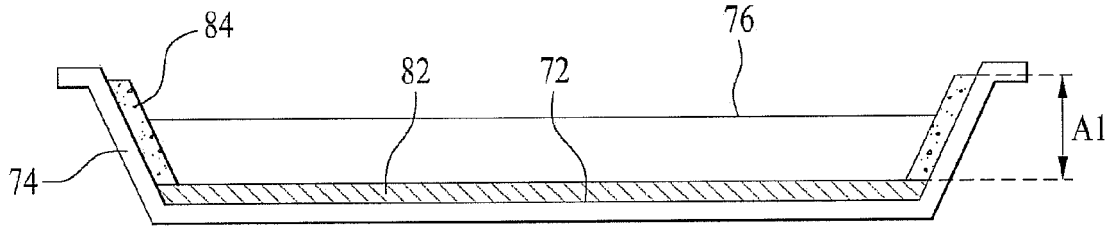

With reference to FIGS. 1 and 4D, the backlight unit includes at least one light source module 10, an optical member 40, a cover plate 50, a bottom cover (or a bottom chassis or a mold body) 70, a first reflector (or a reflective layer) 80, a second reflector 82, and a third reflector 84.

The at least one light source module 10 is disposed between the first reflector 80 and the second reflector 82.

Further, the first reflector 80 may serve to reflect light generated from the light source module 10 to the second reflector 82.

The light source module 10 may be disposed close to the first reflector 80, the second reflector 82 and the third reflector 84. According to circumstance, the light source module 10 may contact the first reflector 80 and be separated from the second reflector 82 by a designated interval, or may contact the second reflector 82 and be separated from the first reflector 80 by a designated interval. Otherwise, the light source module 10 may be separated from both the first reflector 80 and the second reflector 82 by designated intervals, or may contact both the first reflector 80 and the second reflector 82.

The light source module 10 disposed on the cover plate 50 may include light emitting devices serving as light sources 12 to generate light, and a circuit board 14 having an electrode pattern.

Here, at least one light emitting device 12 may be mounted on the circuit board 14, and the electrode pattern to connect the light emitting device 12 to an adapter supplying power is disposed on the circuit board 14. In these embodiments or other embodiments, the light emitting device 12 may be semiconductor light emitting device, for example light emitting diode.

For example, a carbon nano tube electrode pattern to connect the light emitting device 12 to the adapter may be disposed on the upper surface of the circuit board 14. Such a circuit board 14 may be a printed circuit board (PCB) which is formed of one selected from the group consisting of polyethylene terephthalate (PET), glass, polycarbonate (PC) and silicon (Si) and on which plural light sources 12 are mounted, or be formed as a film. Further, the circuit board 14 may selectively employ a single layer PCB, a multi-layer PCB, a ceramic substrate, a metal core PCB, etc.

The light emitting device 12 may be an LED chip, and the LED chip may be a blue LED chip or an ultraviolet LED chip, or a package in which at least one of a red LED chip, a green LED chip, a blue LED chip, a yellow-green LED chip or a white LED chip are combined.

Here, the white LED may be produced by combining a yellow phosphor with a blue LED, by using both a red phosphor and a green phosphor on a blue LED, or by using a yellow phosphor, a red phosphor and a green phosphor on a blue LED.

Further, a light emitting surface of the light source module 10 may be disposed in various directions.

That is, the light source module 10 may have a direct emitting type structure in which the light emitting surface of the light source module 10 is disposed in the direction of an air guide between the optical member 40 and the second reflector 82, or may have an indirect emitting type structure in which the light emitting surface of the light source module 10 is disposed in the direction of one of the first reflector 80, the second reflector 82, the third reflector 84 and the cover plate 50. Here, in the case of the indirect emitting type light source module 10, light emitted from the light source module 10 may be reflected by the first reflector 80, the second reflector 82, the third reflector 84 and the cover plate 50, and then the reflected light may travel in the direction of the air guide of the backlight unit. The reason why the indirect emitting type light source module 10 is provided is to reduce hot spots.

Then, the first reflector 80 and the second reflector 82 may be separated from each other by a designated interval and be opposite to each other so that the air guide is provided between a vacant space between the first reflector 80 and the second reflector 82.

Here, the first reflector 80 may have an opened area, and may contact or be separated from one side of the light source module 10 by a designated interval. In other words, the central area of the first reflector 80 may be opened, and the light source module 10 may be disposed at the edges of both sides of the first reflector 80 so as to be opposite to each other.

The first reflector 80 may be formed of one of a reflective coating film and a reflective coating material layer, and may serve to reflect light generated from the light source module 10 toward the second reflector 82.

Further, a saw-toothed reflective pattern is formed on a portion of the surface of the first reflector 80 opposite to the light source module 10, and the surface of the saw-toothed reflective pattern may be flat or curved.

The reason why the reflective pattern is formed on the surface of the first reflector 80 is to reflect light generated from the light source module 10 to the central area of the second reflector 82 to increase brightness of the central area of the backlight unit.

The second reflector 82 is separated from the light source module 10 by a designated interval, is disposed on a bottom part 72 of the bottom cover 70, and includes a surface inclined from a horizontal plane in parallel with the surface of the first reflector 80 at a designated angle.

Here, the inclined surface of the second reflector 82 may serve to reflect light generated from the light source module 10 or light reflected by the first or third reflector 80 or 84 to the opened area of the first reflector 80.

Further, the second reflector 82 may include at least two inclined surfaces having at least one inflection part. According to circumstance, the central area of the second reflector 82 may have a flat surface shape or a curved surface shape. In other words, the central rear of the second reflector 82 may have one of a flat surface shape, a convex surface shape and a concave surface shape, or may have plural shapes thereof.

According to circumstance, the light source module 10 mat be separated from the first reflector 80 by a first distance and be separated from the second reflector 82 by a second distance. Here, the second distance may be greater than the first distance. The reason for this is to concentrate light generated from the light source module 10 at the central area of the second reflector 82, thereby increasing brightness of the central area of the backlight unit. Otherwise, the second distance may be smaller than the first distance.

The second reflector 82 is not parallel with the first reflector 80, and may be at least one of a flat surface, a flat inclined surface, a convex inclined surface or a concave inclined surface.

Further, the second reflector 82 may be a reflective film attached to the bottom part 72 of the bottom cover 70 having an inclined surface, a reflective film having an inclined surface and being attached to the bottom part 72 of the bottom cover 70 having a flat surface, or the bottom part 72 itself having an inclined reflective surface.

Here, the reflective film may be formed of at least one of a metal or a metal oxide, and, for example, may be formed of a metal or a metal oxide exhibiting high reflectivity, such as aluminum (Al), silver (Ag), gold (Au) or titanium oxide ($TiO_2$).

The reflective patterns of the first reflector 80 and the second reflector 82 may differ from each other. In other words, the first reflector 80 may include a specular reflection surface to execute specular reflection of light, and the second reflector 82 may include a scattered reflection surface to execute scattered reflection of light. Otherwise, the first reflector 80 may include a scattered reflection surface to execute scattered reflection of light, and the second reflector 82 may include a specular reflection surface to execute specular reflection of light.

According to circumstance, the second reflector 82 may include a specular reflection surface disposed at an area close to the light source module 10 and a scattered reflection surface disposed at an area distant from the light source module 10.

The optical member 40 may be supported by the cover plate 50 and be disposed so as to be opposite to the second reflector 82. Here, the optical member 40 may include at least one sheet, e.g., may selectively include a diffusion sheet, a prism sheet, a brightness enhancement sheet, etc. Here, the diffusion sheet serves to diffuse light emitted by the light sources, the prism sheet serves to guide diffused light to a light emission area, and the brightness enhancement sheet serves to enhance brightness. Further, an uneven structure to uniformly diffuse light may be formed on at least one of the upper and lower surfaces of the optical member 40.

The cover plate 50 may contact the first reflector 80 to fix the first reflector 80. Here, the cover plate 50 may be formed of a material differing from the bottom cover 70 including the second reflector 82. In other words, the cover plate 50 may be formed of a metal.

The bottom cover 70 provided with the bottom part 72 on which the second reflector 82 is disposed includes at least two inclined surfaces having at least one inflection part, and the curvatures of the first and second inclined surfaces connected to the inflection part may be different.

Further, the bottom cover 70 may be formed of a polymeric resin, such as plastic, so as to be produced through injection molding.

Figure 2A:
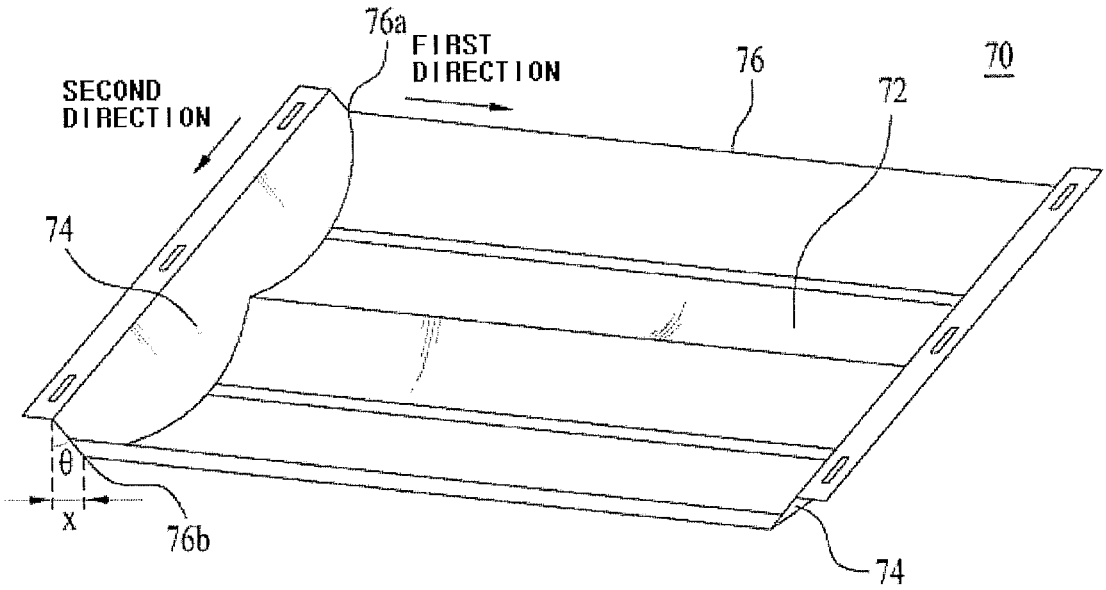
FIGS. 2A and 2B are perspective and plan views of a bottom cover in accordance with the embodiment.
Figure 2B:
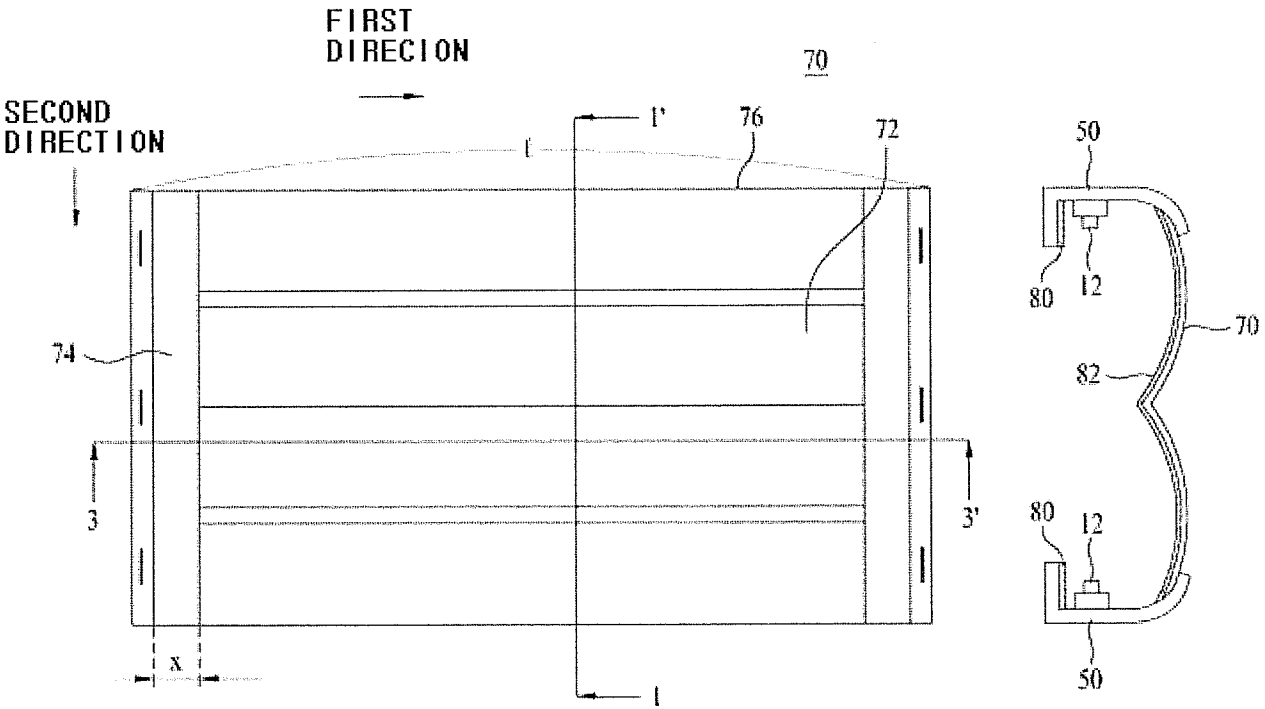

FIG. 2A is a perspective view of the bottom cover 70 in accordance with the embodiment, and FIG. 2B is a plan view of the bottom cover 70 in accordance with the embodiment. FIG. 1 corresponds to a cross-sectional view taken along the line 1-1' of the bottom cover 70 shown in FIG. 2B. Although FIG. 2B illustrates only the bottom cover 70, FIG. 1 illustrates the light source module 10, the optical member 40, the cover plate 50, and the first, second and third reflectors 80, 82 and 84 for convenience of understanding of this embodiment.

The bottom cover 70 in accordance with the embodiment shown in FIGS. 2A and 2B includes the bottom part 72, side wall parts 74, and edge parts 76.

The bottom part 72 supports the second reflector 82, and the side wall parts 74 are inclined from the bottom part 72 and extend. As shown in FIG. 2A, the inclined side wall parts 74 may be provided in plural number.

Figure 3:
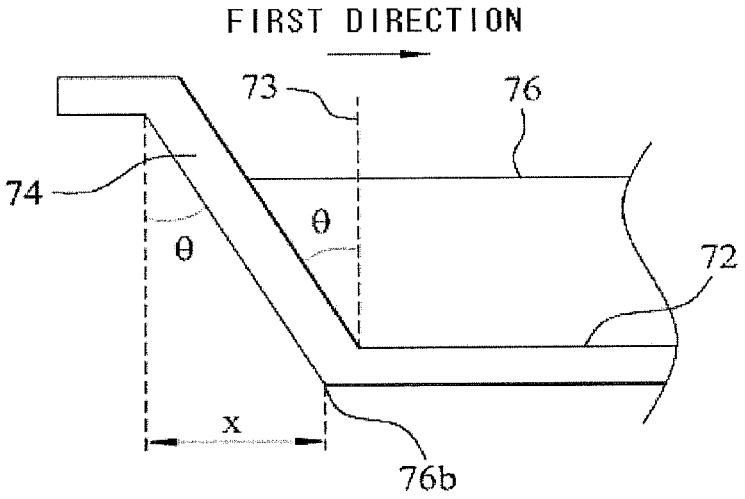
FIG. 3 is a partially enlarged cross-sectional view taken along the line 3-3' of the bottom cover shown in FIG. 2B.

FIG. 3 is a partially enlarged cross-sectional view taken along the line 3-3' of the bottom cover 70 shown in FIG. 2B.

In accordance with the embodiment, the side wall part is inclined by a designated angle θ from a surface 73 perpendicular to the bottom part 72. Here, if the designated angle θ is greater than 53°, dark regions may be generated at the side wall part 74, and thus the designated angle θ may be set to 33° to 53°. For example, the designated angle θ may be 43°.

Further, in accordance with the embodiment, a horizontal distance x from a contact position **76*b* between the side wall part 74 and the bottom part 72 to the outermost position of the side wall part 74 may be 10 mm to 20 mm. For example, the horizontal distance x may be 15 mm. In this case, the length l of the edge part 76 shown in FIG. 2**B may be 526 mm.

In FIG. 3, a ratio x/l of the horizontal distance x from the contact position **76*b* between the side wall part 74 and the bottom part 72 to the outermost position of the side wall part 74 to the length l of the edge part 76** may be 1.85% to 3.85%. For example, the ratio x/l may be 2.85%.

With reference to FIG. 2A, the edge parts 76 extend in the first direction, and the side wall parts 74 extend from front end parts **76*a* of the edge parts 76 in the second direction differing from the first direction. The at least one light source module 10 is disposed with being extended in the first direction along the edge parts 76 of the bottom cover 70**.

FIGS. 4A to 4G are cross-sectional views taken along the line 3-3' of the bottom cover 70 shown in FIG. 2B, in accordance with an embodiment.

With reference to FIGS. 4A to 4G, the side wall parts 74 of the bottom cover 70 in accordance with the embodiment may have various inclined shapes.

As shown in FIG. 4A and FIGS. 4D to 4G, the side wall parts 74 of the bottom cover 70 in accordance with the embodiment may have a flat shape, as seen from the inside of the bottom cover 70.

Alternatively, as shown in FIG. 4B, the side wall parts 74 of the bottom cover 70 in accordance with the embodiment may have a convex shape, as seen from the inside of the bottom cover 70.

Alternatively, as shown in FIG. 4C, the side wall parts 74 of the bottom cover 70 in accordance with the embodiment may have a concave shape, as seen from the inside of the bottom cover 70.

Because the side wall parts 74 of the bottom cover 70 of the backlight unit in accordance with the embodiment are inclined, as described above, the backlight unit in accordance with the embodiment may reduce the size of the bottom part 72, as compared to a general backlight unit having vertical side wall parts. Further, when the size of the bottom part 72 is reduced, the size of the second reflector 82 supported by the bottom part 72 may be reduced. Therefore, the size of the second reflector 82 used in the backlight unit may be reduced, and thus the unit cost of the backlight unit may be lowered.

The backlight unit in accordance with the embodiment may further include the third reflector 84 supported by the inner surfaces of the side wall parts 74 of the bottom cover 70.

However, if the length l of the edge parts 76 shown in FIG. 2B is short, the backlight unit may exclude the third reflector 84. If the length l of the edge parts 76 is short and thus the third reflector 84 is excluded, the size of reflectors used may be further reduced.

Further, the third reflector 84 may be formed of one of a reflective coating film and a reflective coating material layer. Here, the third reflector 84 may be formed of at least one of a metal or a metal oxide, and, for example, may be formed of a metal or a metal oxide exhibiting high reflectivity, such as aluminum (Al), silver (Ag), gold (Au) or titanium oxide ($TiO_2$). Further, the reflectivity of the first and the second reflectors 80 and 82 and the reflectivity of the third reflector 84 may be different or be equal.

In accordance with the embodiment, as shown in FIG. 4D, the third reflector 84 may be supported by the whole area A1 of each of the side wall parts 74. Further, as shown in FIGS. 4E to 4G, the third reflector 84 may be supported by a partial area A2, A3 or A4 of each of the side wall parts 74.

Figure 4E:
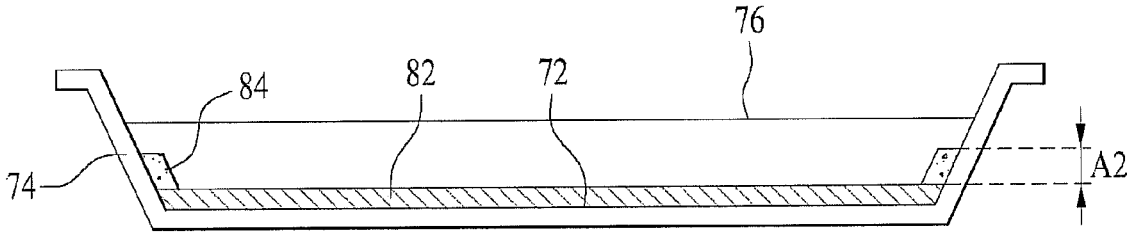

If the third reflector 84 is supported by a partial area of each of the side wall parts 74, the third reflector 84 may cover a lower area A2 of each of the side wall parts 74, as shown in FIG. 4E. Otherwise, the third reflector 84 may cover an upper area A3 of each of the side wall parts 74, as shown in FIG. 4F. Otherwise, the third reflector 84 may cover a central area A4 of each of the side wall parts 74, as shown in FIG. 4G.

Further, the third reflector 84 may contact the second reflector 82, as shown in FIG. 4D or 4E.

Figure 4F:
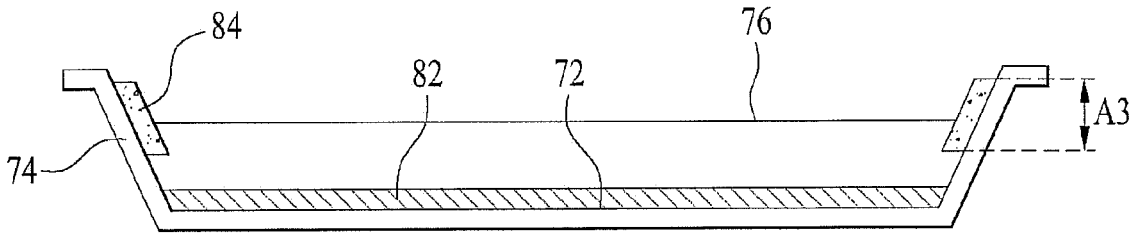
Figure 4G:
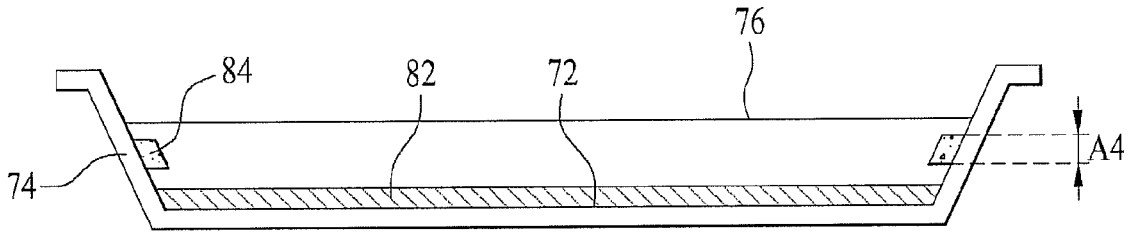

In accordance with another embodiment, the third reflector 84 may be separated from the second reflector 82, as shown in FIG. 4F or 4G.

According to circumstance, the case in which the third reflector 84 is formed at the lower area A2 of each of the side wall parts 74, as shown in FIG. 4E, may further increase brightness of the backlight unit than the case in which the third reflector 84 is formed at the upper area A3 or the central area A4 of each of the side wall parts 74, as shown in FIG. 4F or 4G.

In the above-described embodiment, because the side wall parts 74 of the bottom cover 70 are inclined, manufacturing costs of the bottom cover 70 and the reflectors 80, 82 and 84 may be lowered.

Figure 5:
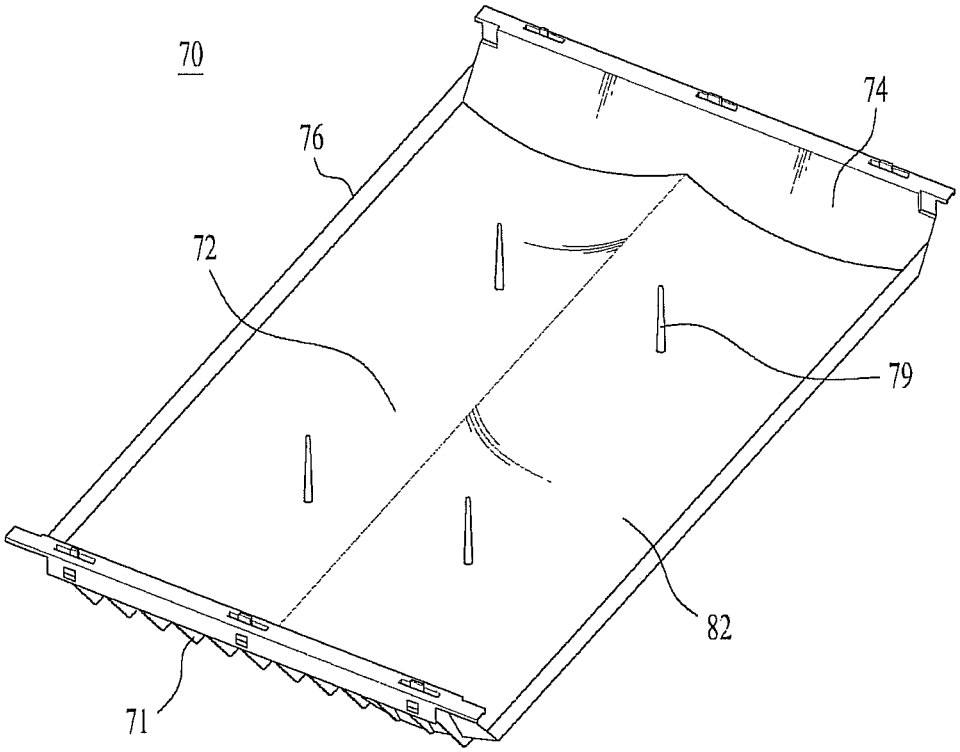
FIG. 5 is a perspective view of the bottom cover having reinforcing ribs and support pins in accordance with the embodiment.

FIG. 5 is a perspective view of the bottom cover 70 having reinforcing ribs 71 and support pins 79 in accordance with the embodiment.

As shown in FIG. 5, plural reinforcing ribs 71 may be provided on the rear surface of the bottom cover 70 shown in FIG. 2A. The reason for this is to prevent deformation of the curved rear surface of the bottom cover 70 having the inclined surface due to external environmental conditions.

The reinforcing ribs 71 may be provided on portions of the rear surface of the bottom cover 70 opposite to the side wall parts 74 supporting the third reflector 84 as well as on portions of the rear surface of the bottom cover 70 opposite to the inclined surface of the bottom part 72 of the bottom cover 70.

With reference to FIG. 5, the bottom cover 70 may further include support pins 79 on the upper surface of the second reflector 82 to support the optical member 40. Because the optical member 40 is separated from the second reflector 82 and the air guide is formed between the optical member and the second reflector 82, central portion of the optical member 40 may sag, and thus the support pins 79 serve to prevent the central portion of the optical member 40 from sagging. For this purpose, the support pin 79 may be configured such that the area of the lower surface of the support pin 79 contacting the second reflector 82 is greater than the area of the upper surface of the support pin 79.

Figure 6:
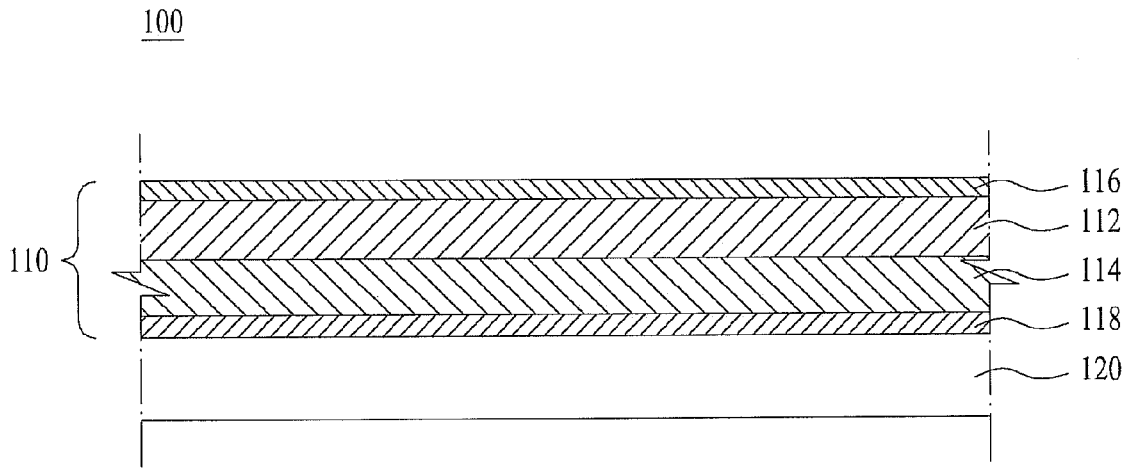
FIG. 6 is a cross-sectional view illustrating a display module having a backlight unit in accordance with one embodiment.

FIG. 6 is a cross-sectional view illustrating a display module having a backlight unit in accordance with the embodiment.

As shown in FIG. 6, a display module 100 may include a display panel 110 and a backlight unit 120.

The display panel 110 includes a color filter substrate 112 and a thin film transistor (TFT) substrate 114 disposed opposite each other and bonded to each other to maintain a uniform cell gap, and a liquid crystal layer (not shown) may be interposed between the two substrates 112 and 114.

Further, an upper polarizing plate 116 and a lower polarizing plate 118 may be disposed on the upper surface and the lower surface of the display panel 110, respectively, and more particularly, the upper polarizing plate 116 may be disposed on the upper surface of the color filter substrate 112 and the lower polarizing plate 118 may be disposed on the lower surface of the TFT substrate 114.

Although not shown in the drawings, gate and data driving units generating driving signals to drive the display panel 110 may be provided on the side wall parts of the display panel 110.

Figure 7:
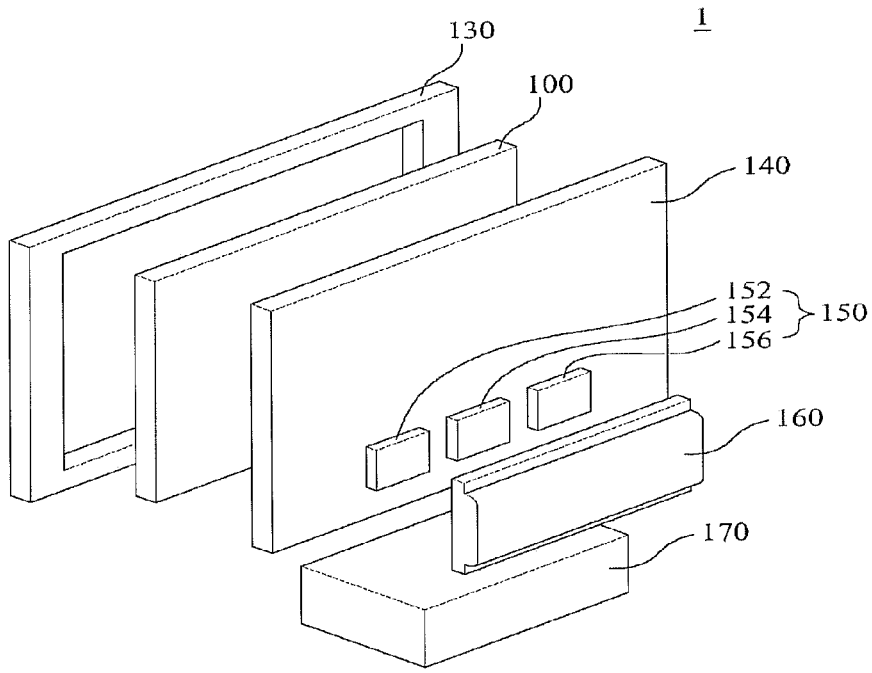
FIGS. 7 and 8 are views respectively illustrating displays in accordance with embodiments.
Figure 8:
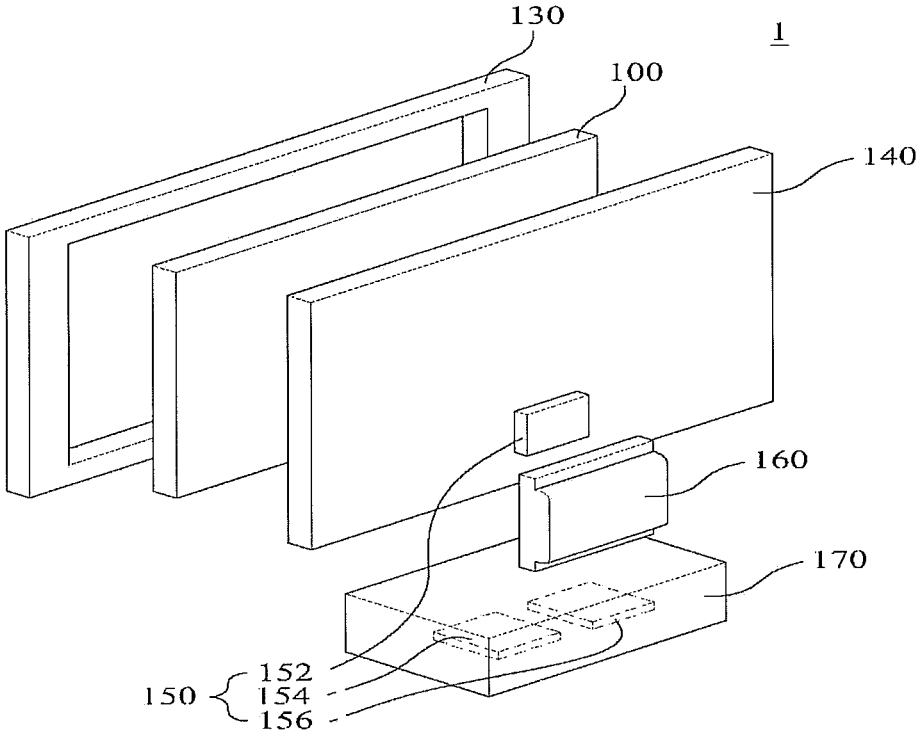

FIGS. 7 and 8 are views respectively illustrating displays in accordance with embodiments.

First, as shown in FIG. 7, a display 1 may include a display module 100, a front cover 130 and a back cover 140 surrounding the display module 100, a driving unit 150 provided on the back cover 140, and a driving unit cover 160 surrounding the driving unit 150.

The front cover 130 may include a front panel (not shown) formed of a transparent material transmitting light. The front panel which is separated from the display module 100 at a designated interval protects the display module 100 and transmits light emitted from the display module 100, thereby allowing an image displayed on the display module 100 to be seen from the outside.

The back cover 140 may be connected to the front cover 130 to protect the display module 100.

The driving unit 150 may be disposed on one surface of the back cover 140.

The driving unit 150 may include a driving control unit 152, a main board 154 and a power supply unit 156.

The driving control unit 152 may be a timing controller, i.e., a driver to control operation timing of respective driver ICs of the display module 100. The main board 154 may be a driver to transmit a V-sync, an H-sync and R, G and B resolution signals to the timing controller. And, the power supply unit 156 may be a driver to apply power to the display module 100.

The driving unit 150 may be provided on the back cover 140 and be surrounded by the driving unit cover 160.

The back cover 140 may be provided with a plurality of holes through which the display module 100 and the driving unit 150 are connected to each other, and a stand 170 to support the display 1 may be provided.

On the other hand, as shown in FIG. 8, the driving control unit 152 of the driving unit 150 may be provided on the back cover 140, and the main board 154 and the power supply unit 156 of the driving unit 150 may be provided on the stand 170.

Further, the driving unit cover 160 may surround only the driving control unit 150 provided on the back cover 140.

Although the embodiments describe the main board 154 and the power supply unit 156 as being separately provided, the main board 154 and the power supply unit 156 may be integrated into one board.

Further, a lighting system may include the above-described backlight unit.

Another embodiment may implement a display, an indication apparatus or a lighting system including the backlight unit described in accordance with the above-described embodiments, for example, the first reflector 81, the second reflector 82 and the light source module 10, and, for example, the lighting system may include a lamp or a streetlight.

Such a lighting system may be used as a lighting lamp which concentrates light emitted from plural LEDs, particularly used as a lamp (down light) which is embedded in the ceiling or the wall of a building and is installed to expose an opening of a shade.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A backlight unit, comprising:
a first reflector;
a second reflector;
at least one light source module between the first reflector and the second reflector; and
a bottom cover comprising:
a bottom part to support the second reflector,
at least one edge part extending in a first direction, the at least one light source module being disposed in the first direction along the at least one edge part, and
at least one side wall part inclined and extending from the bottom part, the at least one side wall part extending from a front end of the at least one edge part in a second direction that is different from the first direction,
wherein the light source module includes a semiconductor light emitting device.

2. The backlight unit according to claim 1, wherein the at least one side wall part is inclined at an angle of 33° to 53° from a surface perpendicular to the bottom part.

3. The backlight unit according to claim 1, wherein a horizontal distance from a contact position between the at least one side wall part and the bottom part to an outermost position of the at least one side wall part is 10 mm to 20 mm.

4. The backlight unit according to claim 1, wherein the at least one side wall part has a convex surface from an inside of the bottom cover.

5. The backlight unit according to claim 1, wherein the at least one side wall part has a concave surface from an inside of the bottom cover.

6. The backlight unit according to claim 1, wherein a ratio of a horizontal distance from a contact position between the at least one side wall part and the bottom part to an outermost position of the at least one side wall part to a length of the at least one side part is 1.85% to 3.85%.

7. The backlight unit according to claim 1, further comprising a third reflector supported by the at least one side wall part.

8. The backlight unit according to claim 7, wherein reflectivity of the first reflector is different than reflectivity of the third reflector.

9. A backlight unit, comprising:
a first reflector;
a second reflector;
a third reflector;
at least one light source module between the first reflector and the second reflector; and
a bottom cover comprising:
a bottom part to support the second reflector,
at least one edge part extending in a first direction, the at least one light source module being disposed in the first direction along the at least one edge part, and
at least one side wall part inclined and extending from the bottom part, and supporting the third reflector, the at least one side wall part extending from a front end of the at least one edge part in a second direction that is different from the first direction,
wherein the light source module includes a semiconductor light emitting device, wherein reflectivity of the first reflector is same as reflectivity of the third reflector.

10. The backlight unit according to claim 7, wherein the third reflector is supported by a whole area of the at least one side wall part.

11. The backlight unit according to claim 7, wherein the third reflector is supported by a partial area of the at least one side wall part.

12. The backlight unit according to claim 11, wherein the third reflector covers a lower area of the at least one side wall part.

13. The backlight unit according to claim 11, wherein the third reflector covers an upper area of the at least one side wall part.

14. The backlight unit according to claim 11, wherein the third reflector covers a central area of the at least one side wall part.

15. The backlight unit according to claim 11, wherein the third reflector contacts the second reflector.

16. The backlight unit according to claim 11, wherein the third reflector is separated from the second reflector.

17. A display, comprising:
a display panel; and
a backlight unit to provide light to the display panel,
wherein the backlight unit comprises:
a first reflector;
a second reflector;
at least one light source module between the first reflector and the second reflector; and
a bottom cover comprising:
a bottom part to support the second reflector,
at least one edge part extending in a first direction, the at least one light source module being disposed in the first direction along the at least one edge part, and
at least one side wall part inclined and extending from the bottom part, the at least one side wall part extending from a front end of the at least one edge part in a second direction that is different from the first direction,
wherein a horizontal distance from a contact position between the at least one side wall part and the bottom part to an outermost position of the at least one side wall part is 10 mm to 20 mm.

18. A lighting system comprising a backlight unit,
wherein the backlight unit includes:
a first reflector;
a second reflector;
at least one light source module between the first reflector and the second reflector; and
a bottom cover comprising:
a bottom part to support the second reflector,
at least one edge part extending in a first direction, the at least one light source module being disposed in the first direction along the at least one edge part, and
at least one side wall part inclined and extending from the bottom part, the at least one side wall part extending from a front end of the at least one edge part in a second direction that is different from the first direction,
wherein a ratio of a horizontal distance from a contact position between the at least one side wall part and the bottom part to an outermost position of the at least one side wall part to a length of the at least one side part is 1.85% to 3.85%.

* * * * *